United States Patent [19]

Cole

[11] 4,374,877

[45] Feb. 22, 1983

[54] AUTOMATICALLY EXPANDING POP-UP DECORATION

[76] Inventor: Bernard M. Cole, 7 Park Drive East, Old Westbury, N.Y. 11568

[21] Appl. No.: 285,033

[22] Filed: Jul. 20, 1981

[51] Int. Cl.[3] ..... G09F 1/00

[52] U.S. Cl. ..... 428/9; 428/11; 428/12; 24/18; 40/312; 40/530

[58] Field of Search ..... 428/4, 7, 8, 9, 11, 428/12; 24/18; 40/312, 530

[56] References Cited

U.S. PATENT DOCUMENTS

| | | | |
|---|---|---|---|
| 1,621,703 | 3/1927 | Adams | 428/9 |
| 2,344,723 | 3/1944 | Pettorossi | 428/9 |
| 3,143,259 | 8/1964 | Paar | 428/5 X |
| 3,174,886 | 3/1965 | Miscovich | 428/4 X |
| 3,174,894 | 3/1965 | Paige | 428/9 |
| 3,370,779 | 2/1968 | Cole | 428/4 X |
| 3,832,841 | 9/1974 | Cole | 428/4X |
| 4,201,806 | 5/1980 | Cole | 428/4 |
| 4,293,601 | 10/1981 | Cole | 428/24 |

*Primary Examiner*—P. Ives

*Attorney, Agent, or Firm*—James & Franklin

[57] ABSTRACT

An automatically expanding pop-up decoration for use in gift-wrapping a package is capable of assuming a compact folded orientation suitable for storage in a limited area, yet expands automatically upon application to a package so as to create a substantially upstanding portion. The decoration comprises an ornament having a pair of opposed end members and an expansible structure pivotally joining the end members together. It further comprises an elastic cord having the opposite ends thereof secured to the opposed ornament end members so that application of the cord about a package so as to tension the cord ends automatically causes the ornament end members to pivot into a substantially edge-to-edge relationship with the expansible structure standing substantially upright from the package.

9 Claims, 4 Drawing Figures

AUTOMATICALLY EXPANDING POP-UP DECORATION

BACKGROUND OF THE INVENTION

The present invention relates to decorations for use in gift-wrapping a package and, more particularly, to such a decoration including an ornament which automatically expands or "pops up" upon application of the decoration to the package.

Decorative ornaments for use in gift-wrapping packages are well known in the art. Decorative ornaments which stand up from the top surface of the package being gift-wrapped add a highly desirable touch of three dimensional class and elegance to the gift-wrapping. U.S. patent application Ser. No. 184,417, filed Sept. 5, 1980, now U.S. Pat. No. 4,293,601, describes such an ornament affording a spray- or fountain-like appearance. Strong deterrents to the use of such stand-up ornaments are, first, the fact that they typically require ample storage space so as not to be crushed or damaged prior to use, and second, frequently must be manually positioned in a vertical orientation to insure that the ornament will stand upright on the package. The first of these deterrents is overcome by the use of expandable ornaments of the type disclosed in U.S. Pat. No. 3,174,894, which ornament, in its unexpanded state, is substantially flat and compact, suitable for storage, and manually openable to provide, in its expanded state, a circular wreath or semi-circular half-wreath (like a fan).

The patent describes its expansible structure as being "a honeycomb structure constituted of a plurality of sheets of tissue paper, each sheet superposed upon another, the sheets being joined together along parallel adhesive lines, staggered on alternate sheets of paper, and progressively built up until an appropriate desired thickness is obtained. In die-cutting the resulting honeycomb blanket in the design of a half profile of a holly-leaf, provision is made for disposing the adhesive lines inwardly from the leaf edge and a second adhesive line disposed at the edges of the simulated leaf adapted to secure the edges of one leaf with its adjacent member. When the tissue sheets forming the simulated leaf are parted in a continuous pull-out form, the resulting leaf will be comprised of a back of one sheet and the front of another, with the inwardly disposed adhesive line forming a central vein in simulation of a natural leaf. The adhesive line securing the tips or edges of the leaf accordingly acts to spread its adjacent member".

While the patent does not suggest use of the half-wreath for gift-wrapping purposes, clearly the same could be adapted for such use simply by manually spreading the ends thereof to form the half-wreath, suitably positioning the expanded half-wreath vertically on the package, and then affixing the half-wreath ends to the package by means of adhesive, stapling or the like. The second deterrent is not, however, alleviated.

Accordingly, it is an object of the present invention to provide an expandable pop-up decoration including an ornament which automatically expands and pops up upon application thereof to a package as part of the gift-wrapping of the package.

Another object is to provide such a decoration which is simple and inexpensive to manufacture, easily and rapidly applied to the package, and securely attachable thereto.

SUMMARY OF THE INVENTION

It has now been found that the above and related objects of the present invention are obtained in an automatically expanding pop-up decoration for use in gift-wrapping a package, such decoration comprising an ornament and an elasticized cord. The ornament has a pair of opposed end members and an expansible structure pivotally joining the end members together. The end members are capable of pivoting between a substantially face-to-face relationship and a substantially edge-to-edge relationship, the ornament being substantially flat when the end members are in the substantially face-to-face relationship, and having a substantially upstanding portion when the end members are in a substantially edge-to-edge relationship. The cord has the opposite ends thereof secured to the opposite ornament end members, whereby application of the cord about a package so as to tension the cord automatically causes the ornament end members to pivot into the substantially edge-to-edge relationship.

In a preferred embodiment, one edge of the expansible structure defines a spine about which the end members pivot. At least one cord end (and preferably each) is secured to at least one ornament end member at a point substantially spaced from the spine. Thus, the cord ends are spaced from one another when the ornament end members are in a substantially edge-to-edge relationship. The cord is secured to the ornament so that application of the cord about a package under tension both secures the ornament to the package and causes a portion thereof to become substantially upstanding.

DETAILED DESCRIPTION OF THE PREFERRED EMBODIMENTS

Figure 1:
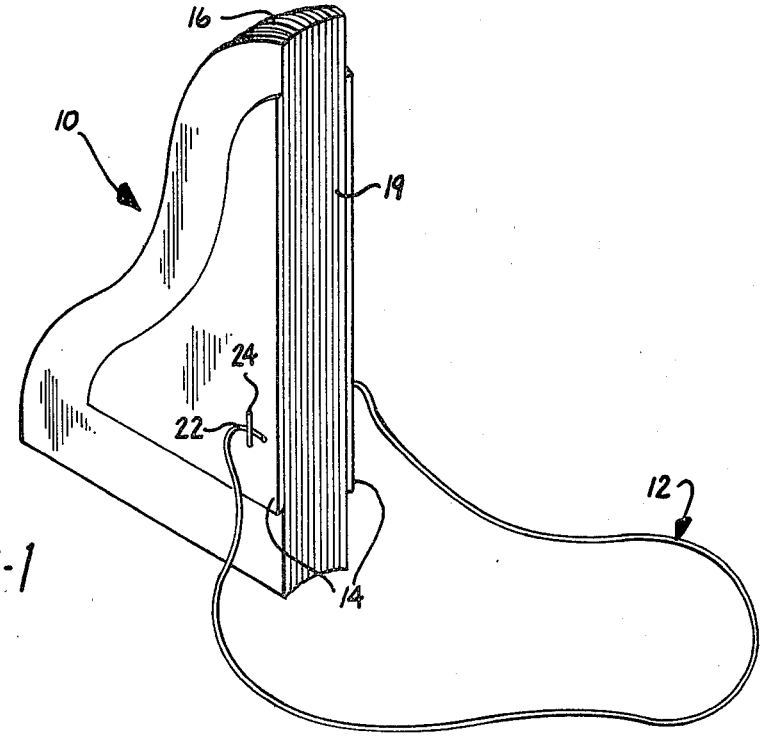
FIG. 1 is an isometric view of a decoration according to the present invention, taken from the spine and one side thereof, and showing the ornament in its collapsed orientation.
Figure 2:
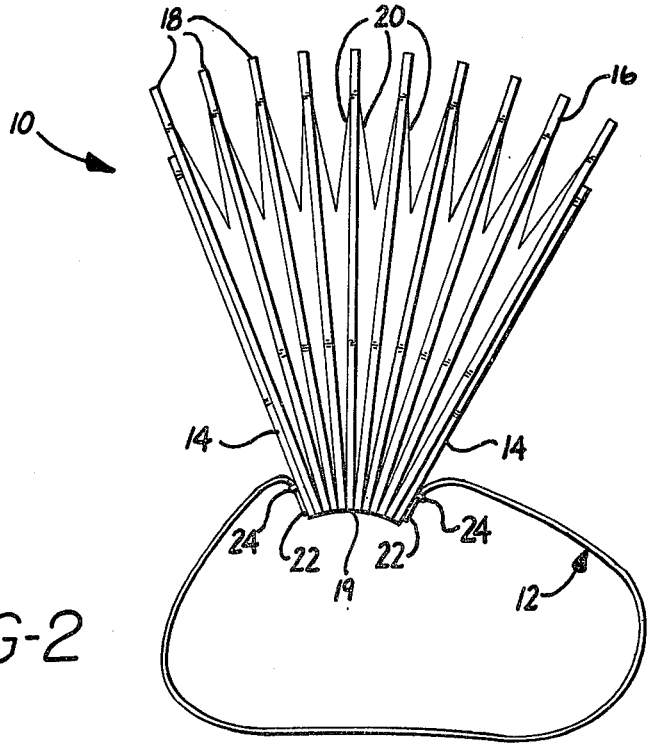
FIG. 2 is a top elevation view of the decoration, showing the ornament in a partially expanded orientation.

Referring now to the drawings, and, in particular, to FIGS. 1 and 2 thereof, the decoration of the present invention is suitable for use in gift-wrapping a package, generally designated by the letter A (shown in FIGS. 3 and 4), and comprises an ornament, generally designated by the numeral 10, and an elasticized cord, generally designated by the numeral 12. The accordian-like ornament 10 comprises a pair of opposed end members 14 and an expansible structure 16, joining the end members together.

The precise nature of the expansible structure 16 is not a part of the present invention, and many of the expansible structures described in the prior art are useful in the present invention. For example, an expansible structure of the type described in the aforementioned U.S. Pat. No. 3,174,894 may be used.

The ornament of the present invention, as shown in FIGS. 1–4, is in the shape of a half-bell (rather than a holly-leaf) and consists primarily of a plurality of spokes 18, with each pair of adjacent spokes being interconnected by means of folded connectors 20. While it is possible for the spokes 18 at each end of the expansible structure 16 to constitute the ornament end members 14, preferably, there are separate end members 14 secured to the outer spokes 18, the end members 14 being of a strengthening material stronger than the spokes 18 and, thus, less likely to tear. The end members 14 may be of the same size and configuration as the spokes 18, but, if desired, may be smaller (as shown). The end members 14 may be secured to the outer spokes 18 by any conventional fastening techniques, including adhesive means, stapling, and the like.

When the ornament 10 is in its collapsed state or orientation, it lies substantially flat and occupies a minimum of storage space. In this orientation, the end members 14 are in a substantially face-to-face relationship (with the expansible structure 16 therebetween). While the drawing illustrates the use of two separate and distinct, unjoined end members 14, it is also possible to utilize a single relatively large sheet of strengthening material, suitably folded at the spine 19, so as to form a pair of connected end members 14. In such an instance, the ornament 10, in its collapsed orientation, still has the end members 14 in substantially face-to-face relationship, but generally such end members 14 would not be capable of assuming the substantially parallel relationship illustrated in FIG. 1.

The shape of the ornament 10 is selected for the particular aesthetic value desired and may be, for example, a half-wreath, a half-tree, or the like, as found suitable for particular gift-giving occasions. Furthermore, the materials from which the ornament is constructed can be varied to achieve desired effects, the expansible structure 16 typically being foil, cardboard, piece goods or the like, and the end member 14 being cardboard, plastic or other somewhat stronger material than that used for the expansible structure.

The elasticized cord 12 is in the form of a loop with the opposite ends 22 thereof secured to the opposed ornament end members 14 by any conventional means, such as, for example, staples 24. While it is preferable that the end members 14 be secured to the expansible structure 16 over a large area, if only a point connection is to be utilized, the same staple 24 may be used both to secure an end member 14 to both a cord end 22 and to the expansible structure 16. Obviously, adhesives or other fasteners may be used instead of the staples 24 and, in some cases, it is even possible to merely pass the cord ends 22 through suitably provided apertures in the end members 14, each cord end 22 then being individually knotted to prevent withdrawal of the cord end 22 through its associated end member aperture.

Each of the cord ends 22 is secured to its respective ornament end member 14 at a point substantially spaced from the spine 19, so that when the decoration is applied to a package A, the tensed cord ends 22 apply to ornament end members 14, turning a moment about the spine 19, and each end member 14 flips over and pivots until it rests on its side on the package A.

Figure 3:
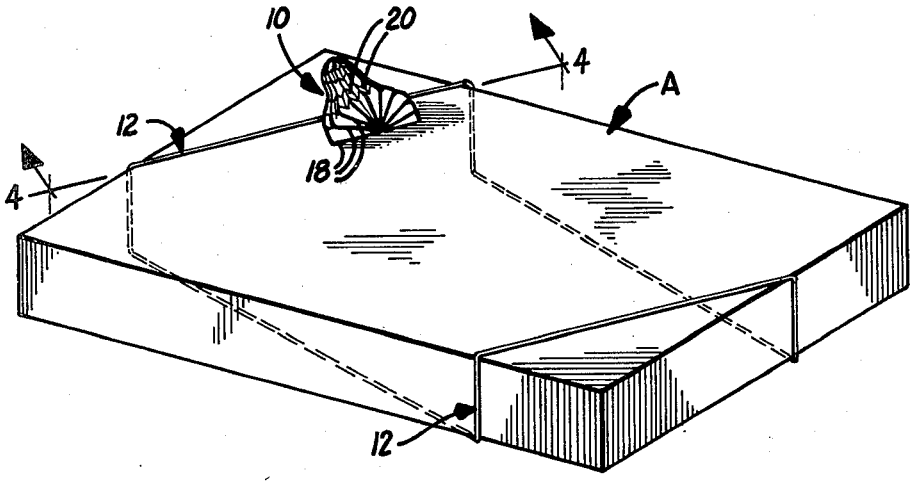
FIG. 3 is an isometric view of the decoration applied to a package, showing the ornament in its expanded orientation; and, FIG. 4 is an elevation view, partially in section, taken along line 4—4 of FIG. 3.
Figure 4:
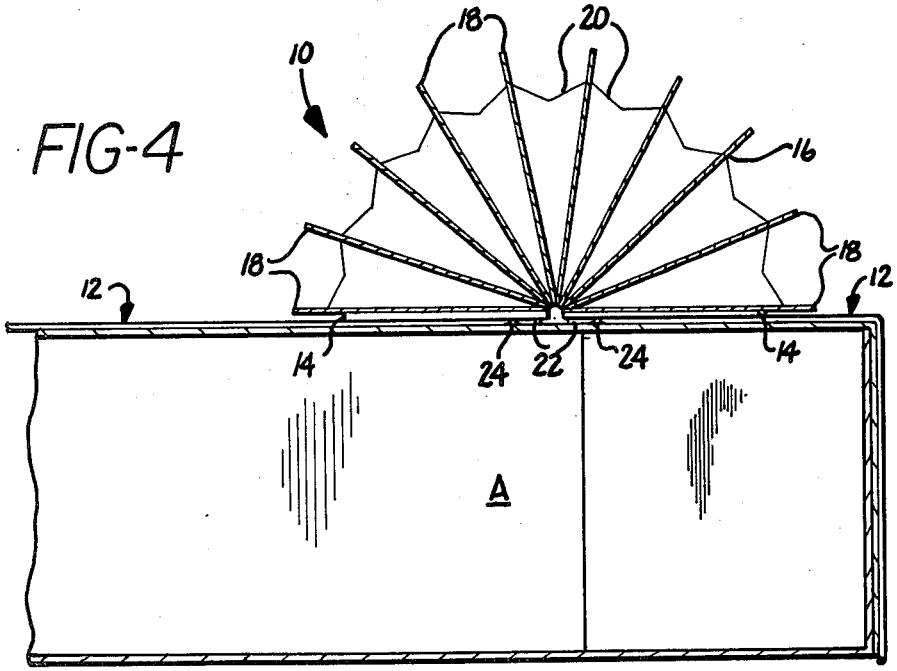

Whereas FIG. 1 illustrates the decoration in its storage orientation, and FIG. 2 illustrates the decoration in only a partially expanded orientation, FIGS. 3 and 4 illustrate the decoration in its open, fully expanded orientation, as it would be found when applied to a package A. Referring now, in particular, to FIGS. 3 and 4, the cord 12 may be applied to the package A in the normal "fancy" wrapping style shown in FIG. 3, or it may be simply slipped over the package A in more mundane fashion. In any case, as the cord 12 is applied about the package A so as to tense the cord ends 22, the ornament end members 14 automatically pivot and assume a substantially edge-to-edge relationship—that is, the end members 14 lie in substantially the same plane. As the end members 14 assume the substantially edge-to-edge relationship, the expansible portion 16 of the ornament 10 expands and forms a substantially upstanding portion which projects upwardly from the plane containing the end members 14 and, hence, from the top surface of the package A.

As most clearly shown in FIG. 4, when the ends members 14 are separate and distinct from each other (as shown), after the decoration is applied to the package, a portion of the expansible structure 16 is, in effect, along with the cord 12 and end members 14, acting to secure the ornament 10 to the package A. Hence, the expansible structure 16 must be sufficiently strong to resist the tension applied thereto by the cord 12 and by any expected handling of the package A. Thus, when the tension to be applied by the cord 12 is high or there is anticipated considerable rough handling of the package A, it is preferred that the end members 14 be portions of a single suitably folded strengthening material so that the ornament is secured to the package A only by means of the cord 12 and end members 14.

It will now be appreciated that conventional application of the cord 12 about the package A under tension automatically performs two separate and distinct functions. First, it secures the ornament 10 to the package A. Second, it causes the expansible portion 16 of the ornament to become substantially upstanding. Thus, the decoration automatically stands and pops-up upon application thereof to the package as part of the gift-wrapping of the package and requires no special operation on the part of the wrapper to especially position the ornament or open same. In addition, the decoration is simple and inexpensive to manufacture, easily and rapidly applied to the package, and securely attachable thereto.

Now that the preferred embodiments of the present invention have been shown and described, various modifications and improvements thereon will become readily apparent to those skilled in the art. Accordingly, the sphere and scope of the present invention is to be limited only by the appended claims, and not by the foregoing disclosure.

I claim:

1. An automatically expanding pop-up decoration for use in gift-wrapping a package comprising:

(A) an ornament having a pair of opposed end members and an expansible structure pivotally joining said end members together, said end members being capable of pivoting between a substantially face-to-face relationship and a substantially edge-to-edge relationship, said ornament being substantially flat when said end members are in a substantially face-to-face relationship and having a substantially upstanding portion when said end members are in a substantially edge-to-edge relationship; and, (B) an elasticized cord having the opposite ends thereof secured to said ornament end members, respectively, whereby application of said cord about a package so as to tension said cord ends automatically causes said ornament end members to pivot into the substantially edge-to-edge relationship.

2. The decoration of claim 1, wherein one edge of said expansible structure defines a spine and said end members are pivotable with respect to each other about said spine.

3. The decoration of claim 2, wherein at least one of said cord ends is secured to at least one of said ornament end members at a point substantially spaced from said spine.

4. The decoration of claim 3, wherein both of said cord ends are secured to said ornament end members at points substantially spaced from said spine.

5. The decoration of claim 3, wherein said cord ends are spaced from one another when said end members are in said substantially edge-to-edge relationship.

6. The decoration of claim 1, wherein said cord is secured to said ornament so that application of said cord about a package under tension both secures said ornament to said package and causes said portion to be substantially upstanding.

7. The decoration of claim 1 wherein said cord ends are separate and not knotted together.

8. The decoration of claim 1 wherein said elasticized cord operatively engages said ornament end members so that application of said cord about a package so as to tension said cord automatically causes said ornament end members to pivot into the substantially edge-to-edge relationship without injuring said expansible structure.

9. The decoration of claim 1 wherein said ornament end members are adapted to lie substantially flat upon the package when said cord is applied about the package under tension.

* * * * *